US005388417A

United States Patent [19]

Hughes, Jr. et al.

[11] Patent Number: 5,388,417

[45] Date of Patent: Feb. 14, 1995

[54] BAG FOR THE RECOVERY OF USED FREON FROM AN OPERATIONAL SYSTEM

[76] Inventors: Andrew J. Hughes, Jr.; Michele D. Hughes, both of 4218 E. Joppa Rd., Baltimore, Md. 21236

[21] Appl. No.: 257,176

[22] Filed: Jun. 9, 1994

[51] Int. Cl.[6] ..... F25B 49/00

[52] U.S. Cl. ..... 62/125; 62/292; 141/114; 141/95

[58] Field of Search ..... 62/77, 125, 292; 141/114, 94, 95

[56] References Cited

U.S. PATENT DOCUMENTS 5,243,828 9/1993 Paige et al. ..... 62/292

5,293,756 3/1994 Nelson et al. ..... 62/292

*Primary Examiner*—John M. Sollecito

[57] ABSTRACT

A bag for the recovery of used freon from an operational system comprising a bag formed of a strong lightweight flexible material having side walls which are cylindrical when expanded and having a closed outboard end and an open inboard end; sensor means within the container to indicate the percent of fullness of the container, the sensor means including a vertically extending support post coupled to the interior surface of the side walls and with an aperture extending centrally therethrough, the axis of the aperture being coextensive with the axis of the bag when expanded, a rotatable shaft secured through the aperture and a rod coupled to the shaft for rotation with regard to the post, the rod being of a length less than the post, the rod having a float ball at one end and an indicator arrow at the other end, and a threaded connector removably coupling the rod to the support bar for removal thereof; and a window formed in the side wall adjacent the pointer adapted to indicate the position of the pointer.

4 Claims, 4 Drawing Sheets

BAG FOR THE RECOVERY OF USED FREON FROM AN OPERATIONAL SYSTEM

BACKGROUND OF THE INVENTION

1. Field of the Invention

The present invention relates to a bag for the recovery of used freon from an operational system and more particularly pertains to recovering freon in a bag adapted to indicate the weight of recovered freon therein and the type of freon within the bag.

2. Description of the Prior Art

The use of bags and miscellaneous containers for receiving and containing a wide variety of materials is known in the prior art. More specifically, bags and miscellaneous containers for receiving and containing a wide variety of materials heretofore devised and utilized for the purpose of storing miscellaneous products in the bag which indicates the quantity and contents of the bag are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,996,848 a method and apparatus for recovering refrigerants from home refrigeration systems.

U.S. Pat. No. 5,159,821 discloses a receiver tank.

U.S. Pat. No. 5,161,385 discloses a refrigerant recovery and recycle system with flexible storage bag.

U.S. Pat. No. 5,182,918 discloses a refrigerant recovery system.

In this respect, the bag for the recovery of used freon from an operational system according to the present invention substantially departs from the conventional concepts and designs of the prior art, and in doing so provides an apparatus primarily developed for the purpose of recovering freon in a bag adapted to indicate the weight of recovered freon therein and the type of freon within the bag.

Therefore, it can be appreciated that there exists a continuing need for a new and improved bag for the recovery of used freon from an operational system which can be used for recovering freon in a bag adapted to indicate the weight of recovered freon thereon and the type of freon within the bag. In this regard, the present invention substantially fulfills this need.

SUMMARY OF THE INVENTION

In view of the foregoing disadvantages inherent in the known types of bags and miscellaneous containers for receiving and containing a wide variety of materials now present in the prior art, the present invention provides an improved bag for the recovery of used freon from an operational system. As such, the general purpose of the present invention, which will be described subsequently in greater detail, is to provide a new and improved bag for the recovery of used freon from an operational system and method which has all the advantages of the prior art and none of the disadvantages.

To attain this, the present invention essentially comprises a new and improved bag for the recovery of used freon from an operational system comprising, in combination: a bag formed of a strong lightweight flexible material having side walls which are cylindrical when expanded and having a closed outboard end and an open inboard end; sensor means within the container to indicate the percent of fullness of the container, the sensor means including a vertically extending support post coupled to the interior surface of the side walls and with an aperture extending centrally therethrough, the axis of the aperture being coextensive with the axis of the bag when expanded, a rotatable shaft secured through the aperture and a rod coupled to the shaft for rotation with regard to the post, the rod being of a length less than the post, the rod having a float ball at one end and an indicator arrow at the other end, and a threaded connector removably coupling the rod to the support bar for removal thereof; a window formed in the side wall adjacent to the pointer adapted to allow viewing of the position of the pointer, indicia at the opposite end of the window including an E for empty at one end and a F for full at the other end to indicate the extent of fullness of the bag, additional indicia indicating the total poundage of the bag and supplemental indicia with a marking space to indicate the type of freon within the bag; and fittings coupled to the open end of the bag, the fittings including external threads on the outermost edge of the bag, an intermediate cylindrical member having internal threads at one end adapted to couple with the threads of the bag, an essentially spherical opening at the center with a rotatable ball with a handle for moving the ball between an open position to allow the flow of freon from exterior to interior of the bag and a closed position to preclude the movement of freon therefrom, the inboard end of the intermediate member being provided with external threads for coupling with respect to a device with freon adapted to be recovered.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bag for the recovery of used freon from an operational system which have all the advantages of the prior art bags and miscellaneous containers for receiving and containing a wide variety of materials and none of the disadvantages.

It is another object of the present invention to provide a new and improved bag for the recovery of used freon from an operational system which may be easily and efficiently manufactured and marketed.

It is further object of the present invention to provide a new and improved bag for the recovery of used freon from an operational system which is of durable and reliable construction.

An even further object of the present invention is to provide a new and improved bag for the recovery of used freon from an operational system which is susceptible of a low cost of manufacture with regard to both materials and labor, and which accordingly is then susceptible of low prices of sale to the consuming public, thereby making such bag for the recovery of used freon from an operational system economically available to the buying public.

Still yet another object of the present invention is to provide a new and improved bag for the recovery of used freon from an operational system which provides in the apparatuses and methods of the prior art some of the advantages thereof, while simultaneously overcoming some of the disadvantages normally associated therewith.

Still another object of the present invention is to recover freon in a bag adapted to indicate the weight of recovered freon thereon and the type of freon within the bag.

Lastly, it is an object of the present invention to provide new and improved a bag for the recovery of used freon from an operational system comprising a bag formed of a strong lightweight flexible material having side walls which are cylindrical when expanded and having a closed outboard end and an open inboard end; sensor means within the container to indicate the percent of fullness of the container, the sensor means including a vertically extending support post coupled to the interior surface of the side walls and with an aperture extending centrally therethrough, the axis of the aperture being coextensive with the axis of the bag when expanded, a rotatable shaft secured through the aperture and a rod coupled to the shaft for rotation with regard to the post, the rod being of a length less than the post, the rod having a float ball at one end and an indicator arrow at the other end, and a threaded connector removably coupling the rod to the support bar for removal thereof; and a window formed in the side wall adjacent the pointer adapted to indicate the position of the pointer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
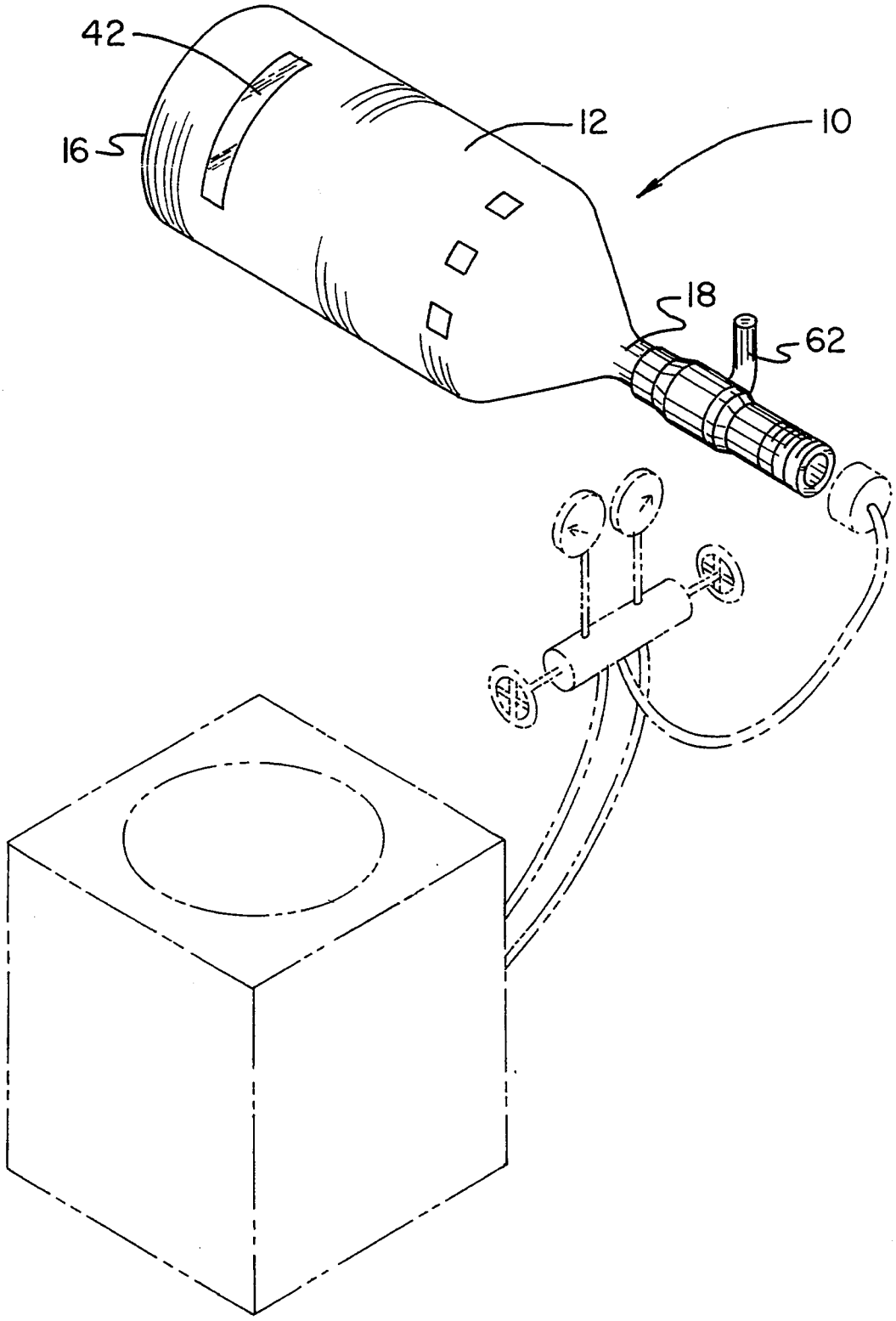
FIG. 1 is a perspective view of the preferred embodiment of the new and improved bag for the recovery of used freon from an operational system constructed in accordance with the principles of the present invention.
Figure 2:
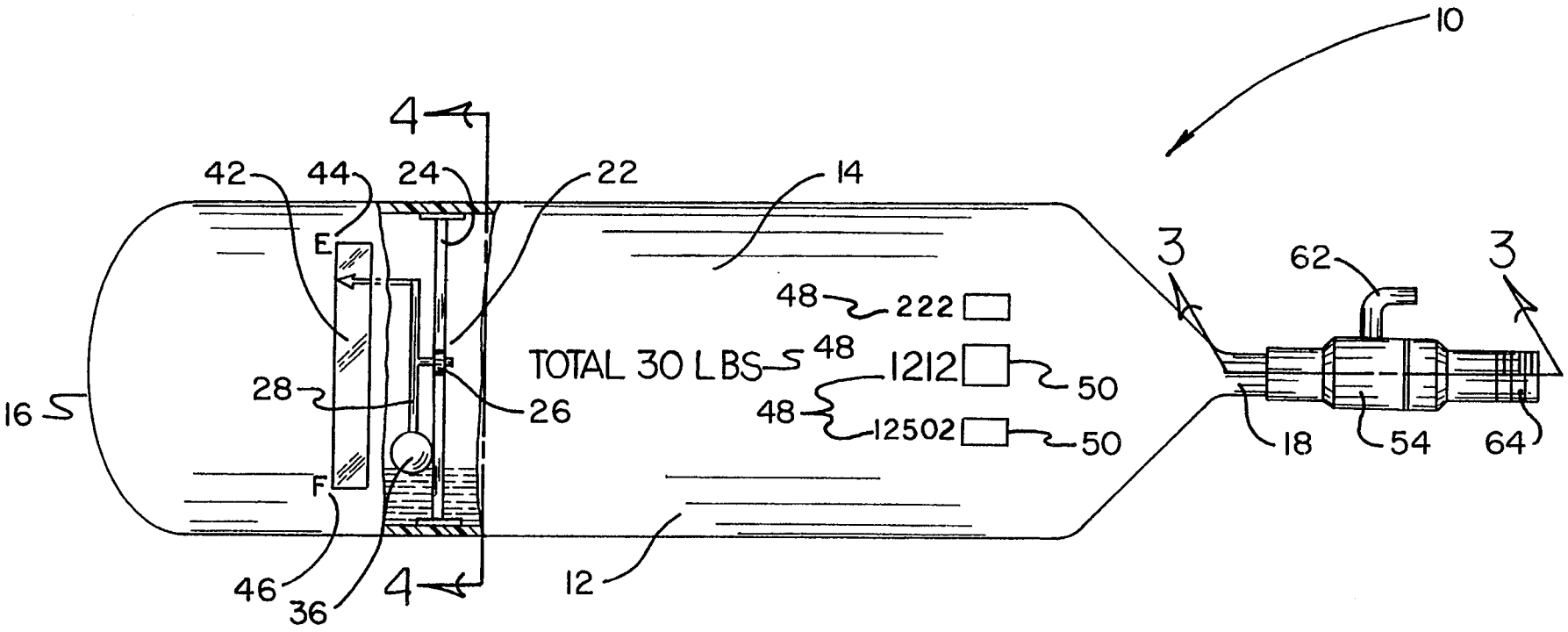
FIG. 2 is a side elevational view partially in cross-section of the bag illustrated in FIG. 1.
Figure 3:
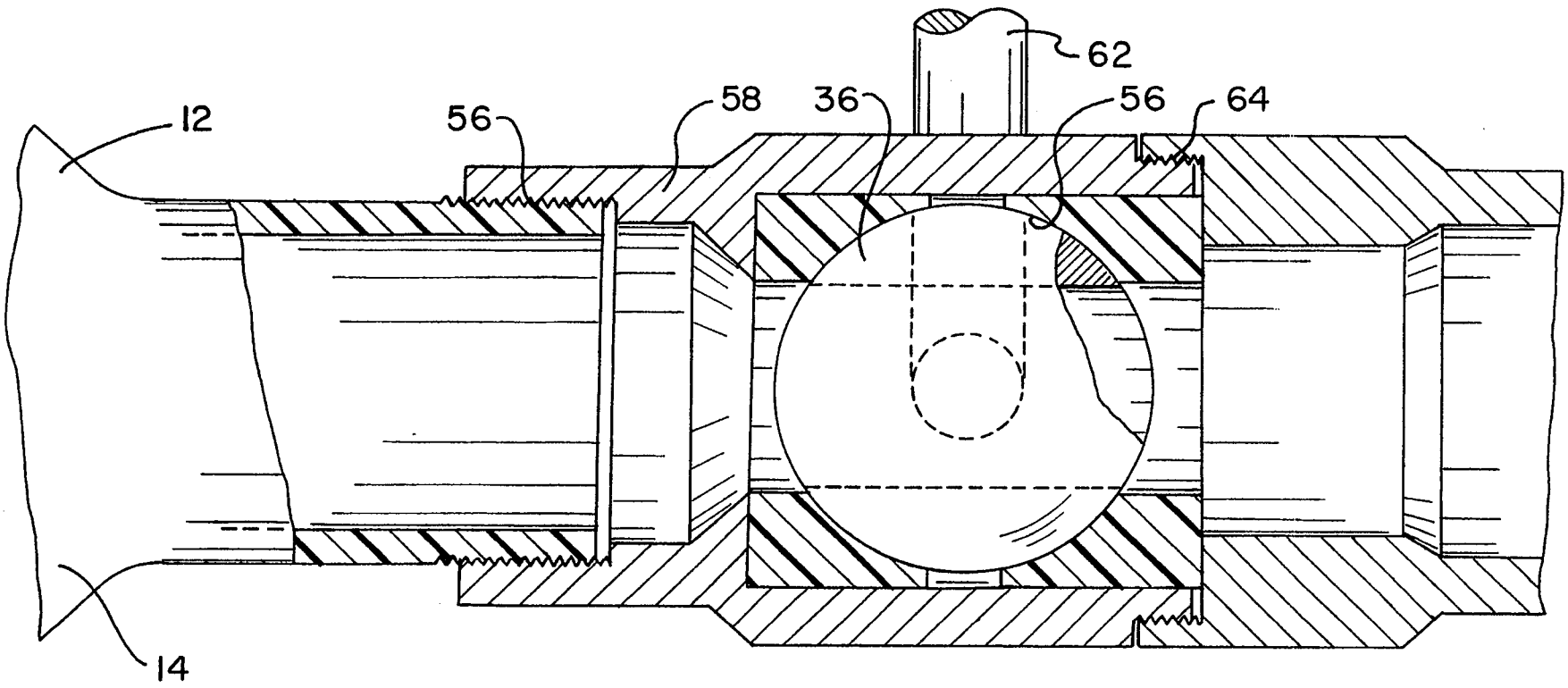
FIG. 3 is a cross-sectional view of the fittings and valve employed in the bag of FIGS. 1 and 2 taken along lines 3—3 of FIG. 2.
Figure 4:
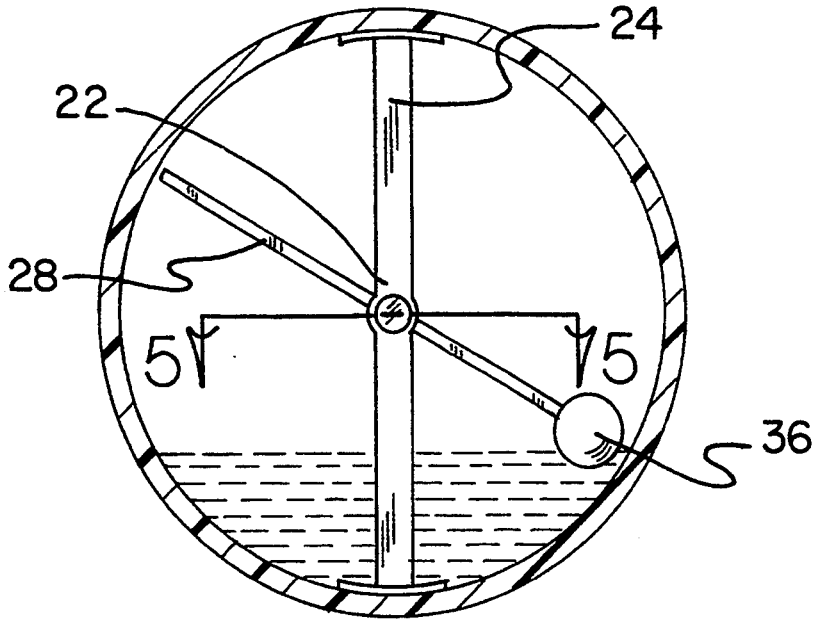
FIG. 4 is a cross-sectional view of the bag illustrating the sensor mechanism and taken along lines 4—4 of FIG. 2.
Figure 5:
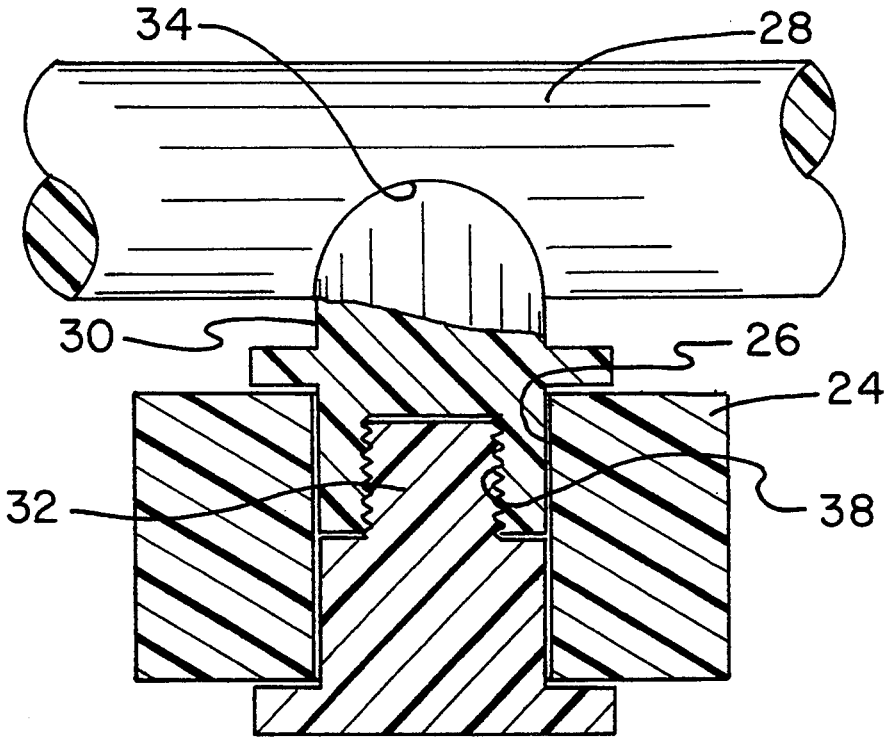
FIG. 5 is an enlarged cross-sectional view of a portion of the sensor taken along lines 5—5 of FIG. 4.

With reference now to the drawings, and in particular to FIG. 1 thereof, the preferred embodiment of the new and improved bag for the recovery of used freon from an operational system embodying the principles and concepts of the present invention and generally designated by the reference numeral 10 will be described.

The present invention, the new and improved bag for the recovery of used freon from an operation system, is a system 10 comprised of a plurality of components. In their broadest context, such components include a bag, sensor, window, and fittings. Such components are individually configured and correlated with respect to each other so as to attain the desired objective.

More specifically, the central component of the system 10 is a bag 12. The bag is formed of a strong lightweight flexible material, preferably of plastic. It has side walls 14 which are cylindrical when expanded. It also has a closed outboard end 16 and an opened inboard end 18.

Located centrally within the bag is a sensor 22. The sensor is located within the container and is adapted to indicate the percent of fullness of the container and, hence, the weight of freon therein. The sensor means includes a vertically extending support post 24. Such support post is coupled at its ends to the interior surface of the side walls. The post has an aperture 26 extending centrally therethrough. The axis of the aperture is essentially coextensive with the axis of the bag when expanded. Secured through the aperture is a rotatable shaft 28. In addition, a rod 30 is coupled to the shaft for rotation with regard to the post. Appropriate fittings 32 couple the various components in this area for allowing the rod to rotate freely with respect to supporting element. The rod is of a length less than the post. It is secured to a recess 34 for proper positioning with respect thereto. The rod has a float ball 36 at one end. It has an indicator arrow extending at a right angle at the other end. In addition, a threaded connector 38 removably couples the rod to the support post for the mounting and removal thereof.

Formed in the side wall is a transparent window 42. The window is preferably of a flexible plastic material like the remainder of the bag. The window is formed adjacent to the pointer. It is adapted to allow viewing of the position of the pointer. Indicia at the opposite ends of the window include an "E" for empty 44 at one end and an "F" for full 46 at the other end. The position of the arrow at either end or at any intermediate point between the ends will indicate the extent of fullness of the bag and therefore the weight of freon therein. Additional indicia 48 is provided. Such additional indicia indicates the total poundage of the bag when full. Supplemental indicia 50 with a marking space is also provided to indicate the type of freon within the bag.

The last component of the system are fittings 54. The fittings are coupled to the open end of the bag. Such fittings include external threads 56 on the outermost edge of the bag. An intermediate cylindrical member 58 is also provided having internal threads at one end. Such internal ends are adapted to couple with the external threads of the bag. An essentially spherical opening is formed at the center of the intermediate cylindrical member. A rotatable ball valve 60 with a handle 62 is provided within the opening. The handle is adapted to move the ball between an opened position to allow the flow of freon therethrough from exterior to interior of the bag. The ball is also movable to a closed position to preclude the movement of freon through the fittings. The inboard end of the intermediate member is provided with external threads 64. Such threads are for coupling with respect to an operational device with freon such as an air conditioning system, with the freon to be recovered.

The present invention is a bag used for recovering freon, liquid or gaseous fluorinated hydrocarbons, from a refrigeration or air conditioning system. Current environmental laws require that all freon, refrigerants, be reclaimed instead of being released into the atmosphere. These laws apply to air conditioning and refrigeration servicing companies who service business, home, and automotive air conditioning or refrigeration systems. Present equipment used to recover the refrigerants are quite large and cumbersome, making it a difficult task. The present invention was designed to make the task easier.

The present invention is made from a strong lightweight plastic or rubber material. At its neck is a shutoff valve and a threaded inlet connection for a refrigerant hose. On the bottom outside is a capacity scale with a needle that indicates the amount of freon in the bag as it expands. The bag is cylindrical in shape and has markings on its outside indicating its capacity in pounds or other unit of measure, depending on the type of refrigerant being collected. The bag's capacity is approximately 30 pounds of freon.

To recover the refrigerant, one attaches the inlet connector to a refrigerant outlet hose, opens the valves on the refrigerant unit and the present invention and collects the freon until it is filled to capacity. The freon is then returned to the recycling shop for cleaning and storage in cylinders until reused.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bag for the recovery of used freon from an operational system comprising, in combination:

a bag formed of a strong lightweight flexible material having side walls which are cylindrical when expanded and having a closed outboard end and an open inboard end;

sensor means within the container to indicate the percent of fullness of used freon within the container, the sensor means including a vertically extending support post coupled to the interior surface of the side walls and with an aperture extending centrally through said post, the axis of the aperture being coextensive with the axis of the bag when expanded, a rotatable shaft secured through the aperture and a rod coupled to the shaft for rotation with regard to the post, the rod being of a length less than the post, the rod having a float ball at one end and an indicator arrow at the other end, and a threaded connector removably coupling the rod to the support bar for removal thereof;

a window formed in the side wall adjacent to the pointer adapted to allow viewing of the position of the pointer, indicia at the opposite end of the window including an E for empty at one end and a F for full at the other end to indicate the extent of fullness of the bag, additional indicia indicating the total poundage of the bag and supplemental indicia with a marking space to indicate the type of freon within the bag; and fittings coupled to the open end of the bag, the fittings including external threads on the outermost edge of the bag, an intermediate cylindrical member having internal threads at one end adapted to couple with the threads of the bag, an essentially spherical opening at the center with a rotatable ball with a handle for moving the ball between an open position to allow the flow of freon from exterior to interior of the bag and a closed position to preclude the movement of freon therefrom, the inboard end of the intermediate member being provided with external threads for coupling with respect to a device with freon adapted to be recovered.

2. A bag for the recovery of used freon from an operational system comprising:

a bag formed of a strong lightweight flexible material having side walls which are cylindrical when expanded and having a closed outboard end and an open inboard end;

sensor means within the container to indicate the percent of fullness of used freon within the container, the sensor means including a vertically extending support post coupled to the interior surface of the side walls and with an aperture extending centrally through said post, the axis of the aperture being coextensive with the axis of the bag when expanded, a rotatable shaft secured through the aperture and a rod coupled to the shaft for rotation with regard to the post, the rod being of a length less than the post, the rod having a float ball at one end and an indicator arrow at the other end, and a threaded connector removably coupling the rod to the support bar for removal thereof; and a window formed in the side wall adjacent the pointer adapted to indicate the position of the pointer.

3. The device as set forth in claim 2 and further including:

fittings coupled to the open end of the bag, the fittings including external threads on the outermost edge of the bag, an intermediate cylindrical member having internal threads at one end adapted to couple with the threads of the bag, an essentially spherical opening at the center with a rotatable ball with a handle for moving the ball between an open position to allow the flow of freon from exterior to interior of the bag in a closed position to preclude the movement of freon therefrom, the inboard end of the intermediate coupling being provided with external threads for coupling with respect to a device with freon adapted to be recovered.

4. The device as set forth in claim 2 and further including:

indicia at the opposite end of the window to indicate with an E for empty at one end and a F for full at the other end to indicate the extent of fullness of the bag.

* * * * *